US010204616B1

(12) United States Patent
Malka et al.

(10) Patent No.: US 10,204,616 B1
(45) Date of Patent: Feb. 12, 2019

(54) DISTANT MICROPHONES FOR NOISE CANCELLATION

(71) Applicant: GM GLOBAL TECHNOLOGY OPERATIONS LLC, Detroit, MI (US)

(72) Inventors: Ilan Malka, Tel Aviv (IL); Eli Tzirkel-Hancock, Ra'Anana (IL); Scott M. Reilly, Southfield, MI (US); Frank C. Valeri, Novi, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/676,278

(22) Filed: Aug. 14, 2017

(51) Int. Cl.
*G10K 11/178* (2006.01)
*H04R 1/02* (2006.01)

(52) U.S. Cl.
CPC ..... *G10K 11/178* (2013.01); *H04R 1/028* (2013.01); *G10K 2210/1282* (2013.01); *G10K 2210/3046* (2013.01); *G10K 2210/3047* (2013.01); *H04R 2499/13* (2013.01)

(58) Field of Classification Search
CPC ..... G10K 11/178; G10K 2210/1282; G10K 2210/3046; G10K 2210/3047; H04R 1/028; H04R 2499/13
USPC ..... 381/74.4, 74.11
See application file for complete search history.

(56) References Cited

U.S. PATENT DOCUMENTS 5,381,485 A * 1/1995 Elliott ..... G10K 11/178 381/71.6
9,240,176 B2 1/2016 Tzirkel-Hancock et al.
9,454,952 B2 9/2016 Tzirkel-Hancock et al.

* cited by examiner

*Primary Examiner* — Paul Kim
*Assistant Examiner* — Douglas J Suthers
(74) *Attorney, Agent, or Firm* — Lorenz & Kopf, LLP

(57) ABSTRACT

Methods and apparatus are provided for controlling noise in a cabin of a vehicle. In various embodiments, a method for controlling noise in a cabin of a vehicle includes measuring a first sound via a microphone in the cabin; obtaining a second sound from a loudspeaker of the cabin; estimating, via a processor, a third sound at a virtual location that is remote from both the microphone and the loudspeaker, using the first sound, the second sound, and one or more transfer functions; and applying active noise cancellation for the cabin based on the third sound at the virtual location.

12 Claims, 9 Drawing Sheets

DISTANT MICROPHONES FOR NOISE CANCELLATION

TECHNICAL FIELD

The technical field generally relates to systems and methods for controlling noise in a vehicle, more particularly to active noise control systems and methods for a motor vehicle.

BACKGROUND

Active noise control ("ANC") systems may be implemented in a motor vehicle, e.g., an automobile, to reduce the amount of noise and undesired sounds that occupants are subjected to. Such systems typically include a microphone to receive noise and at least one loudspeaker to produce an inverted signal corresponding to the noise to be canceled. However, it may be desirable to provide improved ANC functionality for vehicles in certain situations.

Accordingly, it is desirable to provide systems and methods for improved active noise control functionality in a cabin of a vehicle. Furthermore, other desirable features and characteristics of the present invention will become apparent from the subsequent detailed description and the appended claims, taken in conjunction with the accompanying drawings and the foregoing technical field and background.

SUMMARY

In one embodiment, a method is provided for controlling noise in a cabin of a vehicle, the method including measuring a first sound via a microphone in the cabin; obtaining a second sound from a loudspeaker of the cabin; estimating, via a processor, a third sound at a virtual location that is remote from both the microphone and the loudspeaker, using the first sound, the second sound, and one or more transfer functions; and applying active noise cancellation for the cabin based on the third sound at the virtual location.

Also in one embodiment, the first sound includes an aggregate sound that includes a sound pertaining to operation of the vehicle as measured at the microphone; the second sound includes a noise cancellation sound generated via the loudspeaker; and the third sound includes a composite sound, including a sound pertaining to operation of the vehicle and the noise cancellation sound, at the virtual location.

Also in one embodiment, the step of measuring the first sound includes measuring an aggregate sound at the microphone that includes a sound of an engine of the vehicle; the step of measuring the second sound includes obtaining a noise cancellation sound generated via the loudspeaker; the method further includes: (i) estimating an engine sound at the microphone using the aggregate sound at the microphone, the noise cancellation sound generated via the loudspeaker, and a first transfer function; and (ii) estimating an engine sound at the virtual location using the estimated engine sound at the microphone and a second transfer function; and the step of estimating the third sound includes estimating the third sound, which includes an aggregate sound at the virtual location, using the estimated engine sound at the virtual location, the noise cancellation sound, and a third transfer function.

Also in one embodiment, the method includes measuring a torque, a number of revolutions per amount of time, or both, of the engine; and the step of estimating the third sound includes an aggregate sound at the virtual location, using the estimated engine sound at the virtual location, the noise cancellation sound, the third transfer function, and one or both of the torque and revolutions of the engine.

Also in one embodiment, the third sound is estimated using the following equation: $V=E_v+N_v=(R-N*TF_2)*TF_3+N*TF_1$, in which V represents the aggregate sound at the virtual location, $E_v$ represents the engine sound at the virtual location, $N_v$ represents the noise cancellation sound at the virtual location, R represents the aggregate sound at the microphone, N represents the noise cancellation sound generated at the loudspeaker, $TF_1$ represents the first transfer function, $TF_2$ represents the second transfer function, and $TF_3$ represents the third transfer function, and the operator * denotes a convolution operation.

Also in one embodiment, the method includes operating a test vehicle during a first time period in which a loud speaker of the test vehicle is producing noise cancellation sound of the test vehicle; recording a first plurality of testing sounds at a first location corresponding to a location of the microphone of the vehicle during the first time period; recording a second plurality of testing sounds at a second location corresponding to the virtual location of the vehicle during the first time period; operating the test vehicle during a second time period in which the engine of the test vehicle is running but the loud speaker of the test vehicle is not producing the noise cancellation sound of the test vehicle; recording a third plurality of testing sounds at the first location during the second time period; recording a fourth plurality of testing sounds at the second location during the second time period; estimating the first transfer function using the first testing sounds; estimating the second transfer function using the second testing sounds; and estimating the third transfer function using the third testing sounds and the fourth testing sounds.

Also in one embodiment, the method includes measuring revolutions per minute of the engine and an engine torque during the second time period while recording the third testing sounds and the fourth testing sounds; wherein the step of estimating the third transfer function includes estimating the third transfer function using the third testing sounds, the fourth testing sounds, the engine revolutions per minute, and the engine torque.

Also in one embodiment, the method is performed as part of an active noise cancelling system configured for cancelling noise up to a frequency F, and the microphone is installed at a distance larger than 34/F from an ear of a closest occupant to the microphone.

Also in one embodiment, the step of measuring the first sound includes measuring a plurality of first sounds via a microphone array having a plurality of microphones in the cabin; and the step of estimating the third sound includes estimating, via the processor, the third sound at the virtual location that is remote from each of the plurality of microphones of the microphone array and also remote from the loudspeaker, using the plurality of first sounds, the second sound, and one or more transfer functions for each of the plurality of microphones in the array.

In another embodiment, a system for controlling noise in a cabin of a vehicle is provided, the system including a microphone and a processor. The microphone is configured to measure a first sound in the cabin. The processor is in communication with the microphone, and is configured to at least facilitate: obtaining a second sound from a loudspeaker of the cabin; estimating a third sound at a virtual location that is remote from both the microphone and the loudspeaker, using the first sound, the second sound, and one or more transfer functions; and applying active noise cancellation for the cabin based on the third sound at the virtual location.

Also in one embodiment, the first sound includes an aggregate sound that includes a sound pertaining to operation of the vehicle as measured at the microphone; the second sound includes a noise cancellation sound generated via the loudspeaker; and the third sound includes a composite sound, including a sound pertaining to operation of the vehicle and the noise cancellation sound, at the virtual location.

Also in one embodiment, the microphone is configured to (i) measure an aggregate sound at the microphone that includes a sound of an engine of the vehicle; and (ii) the processor is configured to at least facilitate: obtaining a noise cancellation sound generated via the loudspeaker, estimating an engine sound at the microphone using the aggregate sound at the microphone, the noise cancellation sound generated via the loudspeaker, and a first transfer function; estimating an engine sound at the virtual location using the estimated engine sound at the microphone and a second transfer function; and estimating an aggregate sound at the virtual location, using the estimated engine sound at the virtual location, the noise cancellation sound, and a third transfer function.

Also in one embodiment, one or more engine sensors are configured to measure a torque, a number of revolutions per amount of time, or both, of the engine; wherein the processor is configured to at least facilitate estimating the aggregate sound at the virtual location, using the engine sound at the virtual location, the noise cancellation sound, the third transfer function, and one or both of the torque and revolutions of the engine.

Also in one embodiment, the processor is configured to estimate the third sound using the following equation: $V=E_v+N_v=(R-N*TF_2)*TF_3+N*TF_1$, in which V represents the aggregate sound at the virtual location, $E_v$ represents the engine sound at the virtual location, $N_v$ represents the noise cancellation sound at the virtual location, R represents the aggregate sound at the microphone, N represents the noise cancellation sound generated at the loudspeaker, $TF_1$ represents the first transfer function, $TF_2$ represents the second transfer function, and $TF_3$ represents the third transfer function, and the operator * denotes a convolution operation.

Also in one embodiment, the system further includes a memory configured to store the first transfer function, the second transfer function, and the third transfer function after the first, second, and third transfer functions are generated by: (i) operating a test vehicle during a first time period in which a loud speaker of the test vehicle is producing noise cancellation sound of the test vehicle; (ii) recording a first plurality of testing sounds at a first location corresponding to a location of the microphone of the vehicle during the first time period; (iii) recording a second plurality of testing sounds at a second location corresponding to the virtual location of the vehicle during the first time period; (iv)

operating the test vehicle during a second time period in which the engine of the test vehicle is running but the loud speaker of the test vehicle is not producing the noise cancellation sound of the test vehicle; (v) recording a third plurality of testing sounds at the first location during the second time period; (vi) recording a fourth plurality of testing sounds at the second location during the second time period; (vii) estimating the first transfer function using the first testing sounds; (viii) estimating the second transfer function using the second testing sounds; and (ix) estimating the third transfer function using the third testing sounds and the fourth testing sounds.

Also in one embodiment, the third transfer function is further generated by measuring revolutions per minute of the engine and an engine torque during the second time period while recording the third testing sounds and the fourth testing sounds; and estimating the third transfer function using the third testing sounds, the fourth testing sounds, the engine revolutions per minute, and the engine torque.

Also in one embodiment, the system is configured for installation as part of an active noise cancelling system configured for cancelling noise up to a frequency F, in which the microphone is installed at a distance larger than 34/F from an ear of a closest occupant to the microphone.

Also in one embodiment, the system includes a microphone array having a plurality of microphones that are configured to measure a plurality of first sounds in the cabin; and the processor is configured to at least facilitate estimating the third sound at the virtual location that is remote from each of the plurality of microphones of the microphone array and also remote from the loudspeaker, using the plurality of first sounds, the second sound, and one or more transfer functions for each of the plurality of microphones in the array.

In another embodiment, a vehicle includes a passenger cabin and an audio system. The audio system includes a loudspeaker, a microphone, and a processor. The loudspeaker is configured to generate noise cancelling sound. The microphone is configured to provide voice recognition and noise cancelling functionality. The processor is in communication with the microphone and the loudspeaker, and is configured to at least facilitate providing noise cancellation using the loudspeaker and the microphone. The audio system is configured for cancelling noise up to a frequency F, and the microphone is installed at a distance larger than 34/F from an ear of a closest occupant to the microphone.

Also in one embodiment, the microphone is configured to measure a first sound in the passenger cabin; and the processor is configured to at least facilitate: obtaining a second sound from the loudspeaker; estimating a third sound at a virtual location that is remote from both the microphone and the loudspeaker, using the first sound, the second sound, and one or more transfer functions; and providing instructions for the loudspeaker to apply active noise cancellation for the passenger cabin based on the third sound at the virtual location.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
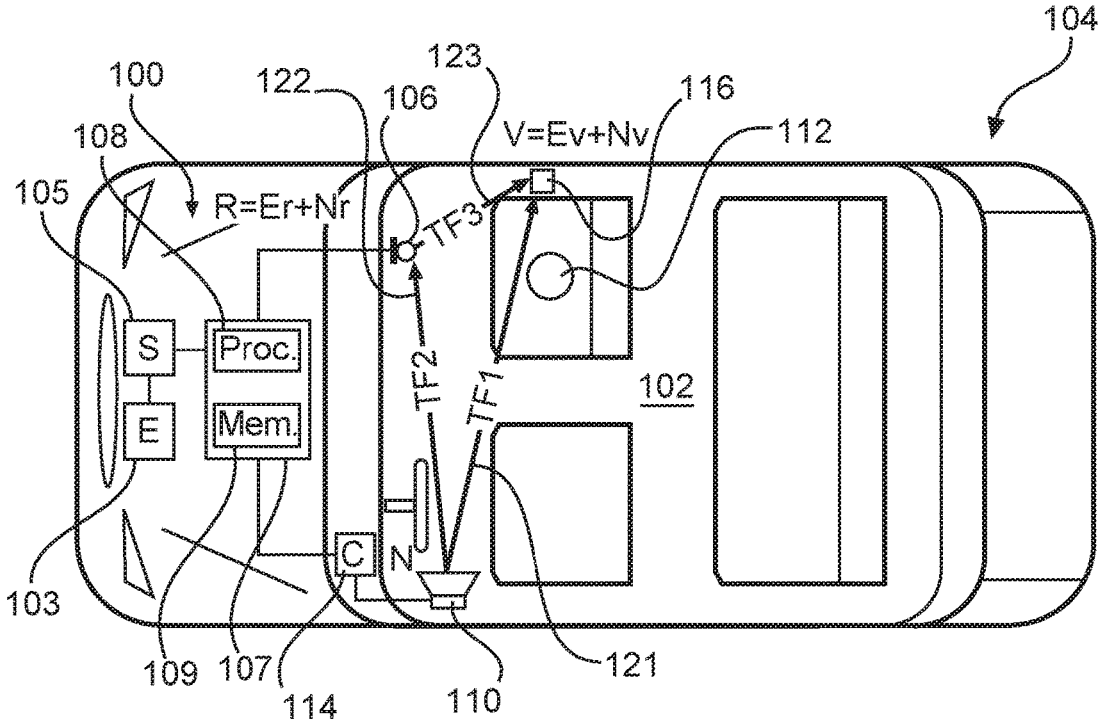
FIG. 1 is a schematic diagram of a vehicle including a system for controlling noise in accordance with various embodiments.

The following detailed description is merely exemplary in nature and is not intended to limit the application and uses. Furthermore, there is no intention to be bound by any expressed or implied theory presented in the preceding technical field, background, brief summary or the following detailed description.

Referring to the figures, wherein like numerals indicate like parts throughout the several views, an audio system 100 and process 200 of controlling noise in a cabin 102, e.g., a passenger interior region, of a vehicle 104 having an engine 103 are illustrated. In certain embodiments, the vehicle 104 comprises an automobile, such as a sedan, truck, bus, or any number of different types of automobiles. It should be appreciated, however, that the system 100 and/or process 200 described herein may be implemented in other types of vehicles 104, including, but not limited to, aircraft and watercraft. Also in various embodiments, the terms "noise" and "sound" may be used synonymously, unless otherwise noted herein.

Referring to FIG. 1, in various embodiments, the audio system 100 includes at least one microphone 106 a computer system 107, one or more loudspeakers 110, and one or more conditioning circuits 114. In certain embodiments, the audio system 100 also includes one or more sensors 105. In various embodiments, the audio system 100 may include multiple microphones 106 and/or multiple sensors 105, computer systems 107, loudspeakers 110, conditioning circuits 114, and/or other components. However, for ease of readability, the microphones 106 may be referred to a single microphone 106 herein (and, similarly, other components may also be referred to in the singular form for ease of convenience).

In various embodiments, the microphones 106 generate signals corresponding to sounds they receive, as is appreciated by those skilled in the art. In certain embodiments, in the audio systems 100 described herein, the microphone 106 comprises an error microphone that generates an error signal corresponding to the received sounds. In certain embodiments, the microphone 106 also records voices of occupants 112 (also referred to herein as passengers) within the vehicle 104, for example to facilitate communications among different occupants 112, and/or between one or more occupants 112 and one or more vehicle systems and/or other individuals remote from the vehicle 104 (e.g., via a telephone, transceiver, computer, and/or other devices).

In various embodiments, the sensors 105 are coupled to the engine 103. Also in various embodiments, the sensors 105 measure data for an engine torque and/or a number of revolutions per amount of time (e.g., revolutions per minute) for the engine 103. It will be appreciated that in certain embodiments the sensors 105 may vary, and/or such sensors 105 may (optionally) not be part of the audio system 100.

In various embodiments, the computer system 107 includes a processor 108 and a memory 109. It will be appreciated that, in various embodiments, the computer system 107 may also include one or more other computer-related components, such as an interface, a bus, a storage device, and so on.

In various embodiments, the memory 109 can be any type of suitable memory. For example, the memory 109 may include various types of dynamic random access memory (DRAM) such as SDRAM, the various types of static RAM (SRAM), and the various types of non-volatile memory (PROM, EPROM, and flash). In various embodiments, the memory 109 comprises non-transitory computer readable storage medium. In certain examples, the memory 109 is located on and/or co-located on the same computer chip as the processor 108. In various embodiments, the memory 109 stores a plurality of transfer functions that are utilized by the processor 108 in controlling noise in the cabin 102. In accordance with certain exemplary embodiments, the transfer functions are denoted as a first transformation function ($TF_1$) 121, a second transfer function ($TF_2$) 122, and a third transfer function ($TF_3$) 123, as depicted in FIG. 1. Also in various embodiments, the memory 109 stores, in addition to the transfer functions, a computer program that is executed by the processor 108 in performing the steps of the process 200 described further below in connection with FIGS. 2-9.

In various embodiments, the processor 108 performs the computation and control functions of the computer system 107, and of the audio system 100. In various embodiments, the processor 108 may comprise any type of processor or multiple processors, single integrated circuits such as a microprocessor, or any suitable number of integrated circuit devices and/or circuit boards working in cooperation to accomplish the functions of a processing unit. In various embodiments, the processor 108 executes one or more programs contained within the memory 109 and, as such, controls the general operation of the computer system 107, generally in executing the processes described herein, including the process 200 described further below in connection with FIGS. 2-9.

In various embodiments, the processor 108 utilizes data from the sensors 105, the microphone 106, and the loudspeaker 110, along with the transfer functions 121, 122, and 123 stored in the memory 109, to estimate noise values at one or more virtual locations 116 in the vehicle 104 (e.g., in proximity to one or more ears of occupants 112 of the vehicle 104). As described in greater detail below, in various embodiments: (i) the first transfer function 121 pertains to a relationship between sound at the loudspeaker 110 and sound at the virtual location 116; (ii) the second transfer function 122 pertains to a relationship between sound at the loudspeaker 110 and sound at the microphone 106; and (iii) the third transfer function 123 pertains to a relationship between sound at the microphone 106 and sound at the virtual location 116.

Also in various embodiments, the processor 108 utilizes the estimated noise values for controlling noise cancellation functionality for the cabin 102 of the vehicle 104, for example by providing noise cancellation instructions for the loudspeaker 110 based on the estimated noise values. In various embodiments, the processor 108 performs these and other steps in accordance with the steps of the process 200, described further below in connection with FIGS. 2-9.

In various embodiments, the processor 108 of the exemplary embodiments is implemented with at least one semiconductor-based microprocessor capable of performing calculations and executing instructions (i.e., running a program). The processor 108 of the exemplary embodiments includes a digital signal processor ("DSP") configured to convert and process analog signals. However, it should be appreciated that the processor 108 may be implemented with any number of suitable devices, schemes, or configurations, as is readily appreciated by those skilled in the art.

Figure 2:
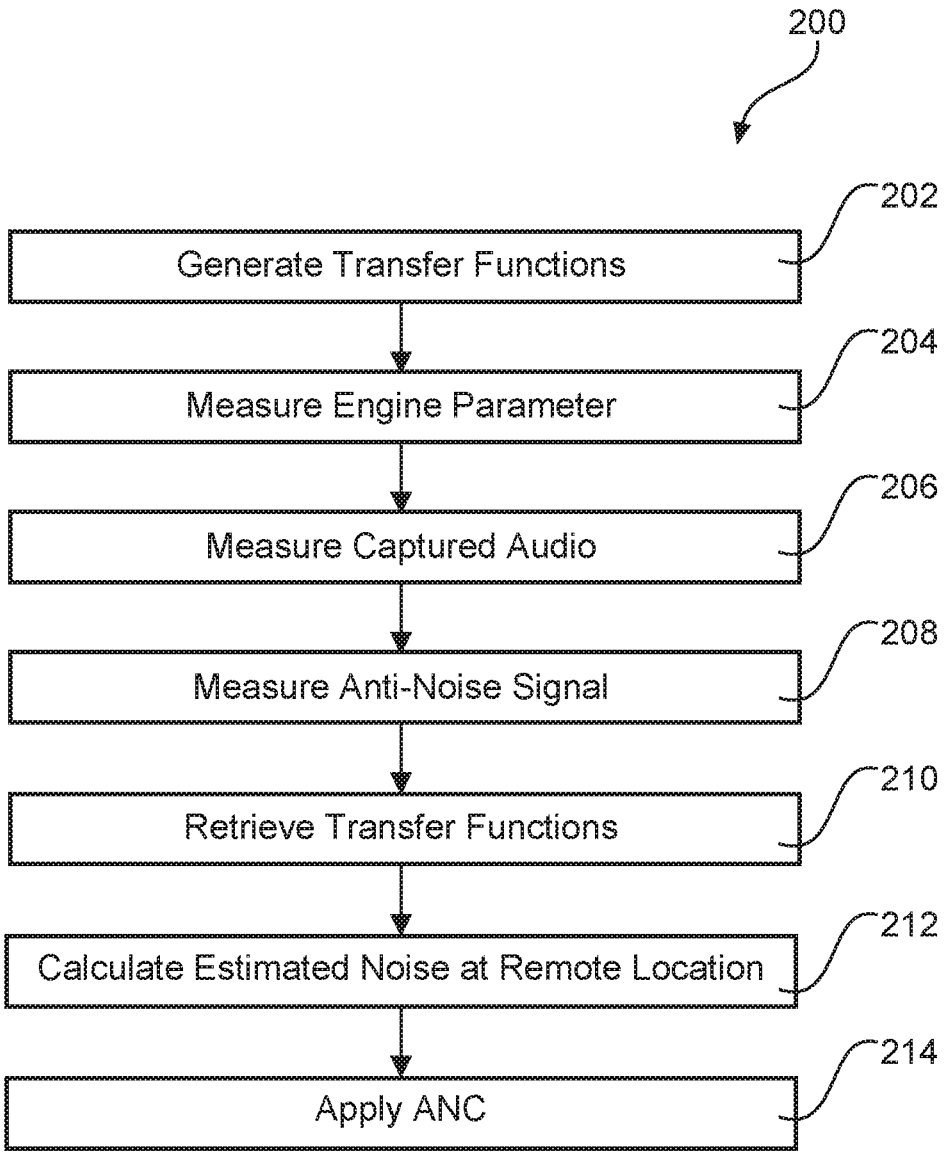
FIG. 2 is a flowchart of a method for controlling noise in accordance with various embodiments.

As noted above, the audio system 100 also includes at least one loudspeaker 110, as shown in FIG. 1. In various embodiments, multiple loudspeakers 110 may be implemented, as is shown in FIG. 2. However, for ease of readability, the loudspeakers 110 may be referred to as a single loudspeaker 110 herein. Loudspeakers generate sounds corresponding to signals they receive, as is appreciated by those skilled in the art. Specifically, in the audio systems 100 described herein, the loudspeaker 110 generates a noise-canceling sound corresponding to the received noise-canceling signal, in accordance with instructions provided by the processor 108. In certain embodiments, the system 100 also includes a conditioning circuit 114 electrically coupled between the loudspeaker 110 and the processor 108.

With reference to FIG. 2, a flowchart is provided for a process 200 for controlling noise in a vehicle, in accordance with various embodiments. In various embodiments, the process 200 can be implemented in connection with the audio system 100, the vehicle 104, and various components thereof of FIG. 1. Also in various embodiments, the process 200 is also discussed further below in connection with FIGS. 3-9, which include presentations of various sub-steps and implementations for the process 200.

As depicted in FIG. 2, the process 200 begins with the step of generating transfer functions (step 202). In various embodiments, the transfer functions of step 202 pertain to the first transfer function ($TF_1$) 121, the second transfer function ($TF_2$) 122, and the third transfer function ($TF_3$) 123 of FIG. 1. Also in various embodiments: (i) the first transfer function pertains to a relationship between sound at a noise cancelling loudspeaker (e.g., loudspeaker 110 of FIG. 1) and sound at a virtual location (e.g., virtual location 116 of FIG. 1); (ii) the second transfer function pertains to a relationship between sound at the loudspeaker and sound at a microphone (e.g., microphone 106 of FIG. 1); and (iii) the third transfer function pertains to a relationship between sound at the microphone and sound at the virtual location.

In various embodiments, the transfer functions are generated during development and/or tuning of a particular vehicle type, "offline" using test vehicles (e.g., prior to sale or consumer ownership or usage of the vehicle 104 of FIG. 1, and prior to operation of the current vehicle 104 for the remaining steps of the process 200). Additional details of exemplary embodiments for the generation of the transfer functions are provided in FIGS. 4-7, and are discussed further below in connection therewith.

The "online" steps of the process 200 begin with step 204 (e.g., after the tuning of the vehicle type is completed using the various test vehicles, and after the vehicle type is on the market, e.g., with the vehicle 104 being operated in a current vehicle driving cycle). Specifically, as the vehicle is operated, in certain embodiments engine parameters are measured at step 204. Also in certain embodiments, an engine torque and a number of revolutions per amount of time (e.g., revolutions per minute) are measured at step 204 using the sensors 105 of FIG. 1. In certain other embodiments the engine parameters may not be required.

In addition, captured audio is recorded via a microphone (or via multiple microphones) at step 206. In various embodiments, during step 206, the microphone 106 of FIG. 1 measures captured audio at the location of the microphone 106, with the captured audio comprising an aggregate sound that include both engine noise for the engine 103 of FIG. 1 as well as noise cancelling sounds (e.g., inverted sounds) generated by the loudspeaker 110 of FIG. 1. As used herein, "engine noise" refers to noise caused by operation of the engine of the vehicle in various embodiments. In certain other embodiments, the "engine noise" may also refer to other noises pertaining to operation of the vehicle, such as road noise from a roadway on which the vehicle is travelling, as well as one or more other noises pertaining to operation of the vehicle (e.g., noise from weather, and so on). In certain other embodiments, such other noises pertaining to operation of the vehicle may be included as part of, or may be used instead of, the "engine noise" as referred to throughout this Application.

Noise cancelling sounds are obtained at step 208. In various embodiments, the noise cancelling sounds refer to inverted sounds, or anti-noise sounds, from the loudspeaker 110 of FIG. 1. In certain embodiments, the noise cancelling sounds are known and/or obtained via the loudspeaker 110 itself, and/or from instructions provided to the loudspeaker 110 (e.g., from the processor 108), at the loudspeaker 110 itself.

Transfer functions are retrieved at step 210. In various embodiments, the first, second, and third transfer functions, namely, $TF_1$ 121, $TF_2$ 122, and $TF_3$ 123, respectively, are retrieved from the memory 109 via the processor 108 of FIG. 1.

One or more sound values are estimated for a virtual location at step 212. In various embodiments, the processor 108 of FIG. 1 estimates an aggregate sound value (e.g., including both engine sound as well as noise cancellation sound) at one or more virtual locations proximate the ears of occupants of the vehicle. For example, in certain embodiments, estimated sounds may be generated proximate virtual location 116 of FIG. 1. In various embodiments, the virtual location may be even closer to the ears of the occupants 112 of FIG. 1 (e.g., immediately or nearly immediately adjacent to an expected location of the ears, and so on). In various embodiments, the estimated sounds at the virtual location are estimated using the measured or obtained sounds of steps 206 and 208 along with the transfer functions of steps 202 and 210. Also in certain embodiments, the engine parameters of step 204 (e.g., engine torque and engine rpm) are also utilized in connection with one or more of the transfer functions. Additional details of exemplary embodiments for the estimation of sound values at the virtual location are provided in FIG. 3, and are discussed further below in connection therewith.

Noise cancellation is applied at step 214. In various embodiments, during step 214, the processor 108 of FIG. 1 provides instructions for the loudspeaker 110 of FIG. 1 to provide noise cancellation sounds (e.g., inverted sounds) to help reduce or eliminate the estimated sounds at the virtual location (i.e., that is proximate to the ears of the occupant 112).

Per the discussion above, it will be appreciated that there may be any number of microphones 106, loudspeakers 110, and occupants 112 for the vehicle 104. Accordingly, in various embodiments, steps 202-214 may be performed individually for each microphone loudspeaker, occupant, and/or combination thereof, thereby generating multiple virtual locations with multiple estimated sounds (and, thus, that may be aggregated, for example using a weighted average, for use in the instructions provided by the processor 108 to the loudspeakers 110).

Figure 3:
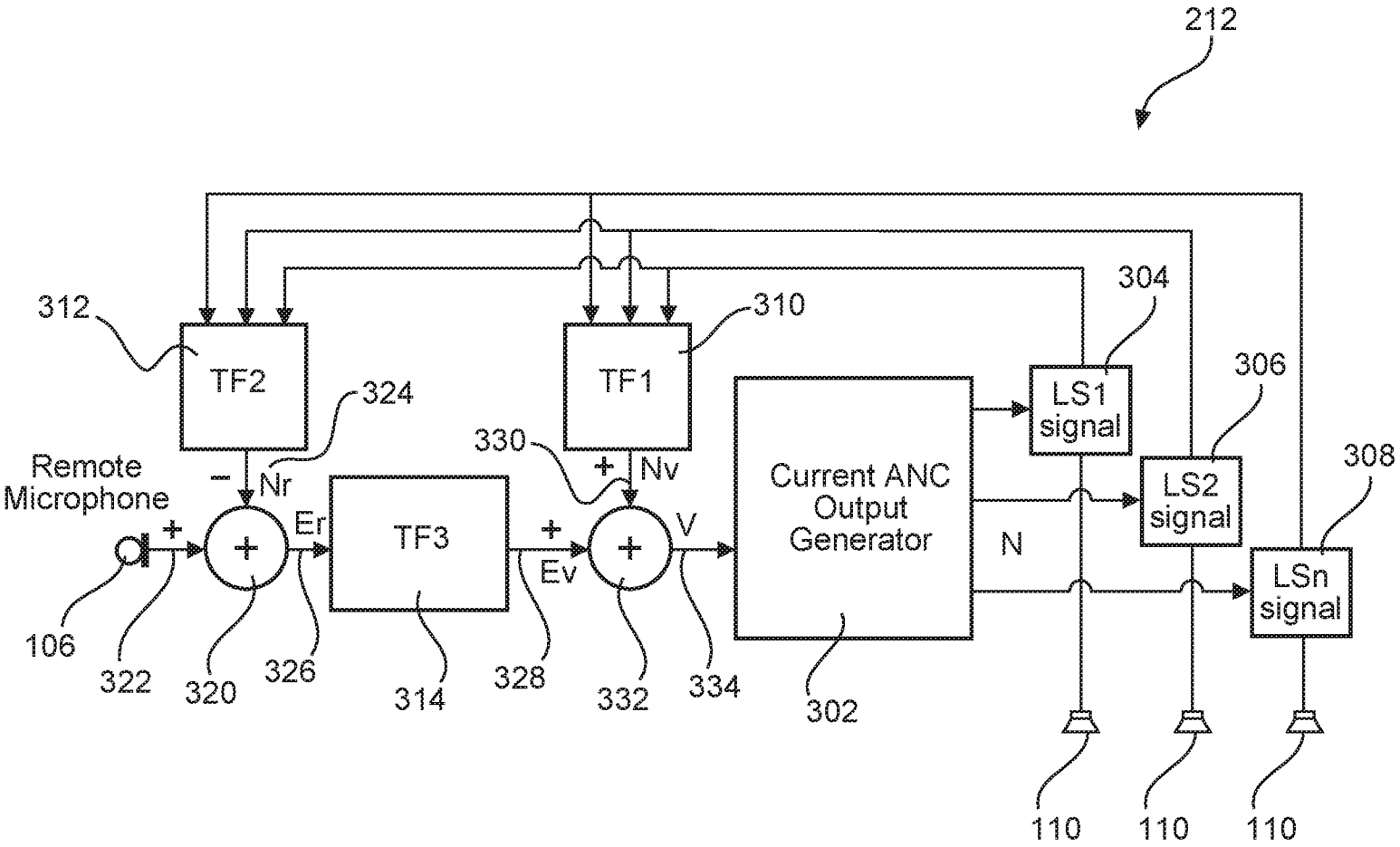
FIG. 3 is a diagram illustrating an exemplary implementation of a step of the method of FIG. 2, namely, calculating an estimated noise at a virtual location, in accordance with various embodiments.

With reference to FIG. 3, a diagram is provided illustrating an implementation of step 212 of the process 200 of FIG. 2, namely, calculating an estimated noise at a virtual location, in accordance with various embodiments. As depicted in FIG. 3, in various embodiments, a current anti-noise cancelling (ANC) output generator 302 generates noise cancelling output signals. In various embodiments, the processor 108 of FIG. 1 provides instructions for various loudspeakers 110 of FIG. 1 to each generate a respective loudspeaker signal that comprises a noise cancelling output signal, or sound. In one exemplary embodiment (depicted in FIG. 3) in which there are three loudspeakers 110, then three loudspeaker signals are generated (i.e., one for each loudspeaker 110), namely, a first loudspeaker signal ($LS_1$) 304, a second loudspeaker signal ($LS_2$) 306, and a third loudspeaker signal ($LS_3$) 308. However, it will be appreciated that in various embodiments the number of loudspeakers 110, and therefore the number of corresponding loudspeaker signals, may vary.

In various embodiments, sound signals 322 are measured and recorded at one or more microphones 106, such as the microphone 106 of FIG. 1. In various embodiments, the sound signals 322 measured at the microphones each comprise an aggregate sound, including both engine sound as well as loudspeaker sounds, at the position/location of the particular microphone. Similar to the discussion above with respect to the loudspeakers 110, it will similarly be appreciated that the number of microphones 106 may similarly vary, and with it the number of corresponding aggregate sound signals 322. For example, in various embodiments, at least one sound aggregate signal 322 is measured by each microphone 106 at the position/location of the microphone 106. Also in various embodiments, the sound signals 322 measured at the microphones 106 are designated with the symbol "R" as referenced below in subsequent calculations. In various embodiments, the symbol "R" represents the aggregate sound of engine noise and loudspeaker noise at the particular location, comprising both the engine noise "($E_r$" as measured at the microphone location and the noise cancellation noise "$N_r$" (i.e., loudspeaker noise, or anti-noise) at the microphone location, in accordance with the following equation:

$$R=E_r+N_r \quad \text{(Equation 1).}$$

In addition, in various embodiments, for each microphone 106, the loudspeaker sound signals (e.g., $LS_1$ 304, $LS_2$ 306, and $LS_3$ 308) are each processed through a respective second transfer function ($TF_2$) 312 for each respective microphone 106 location. Accordingly, for each microphone 106 location, the second transfer function ($TF_2$) 312 generates a loudspeaker cancellation noise value ($N_r$) 324 for the particular microphone 106 location based on the processing of the loudspeaker sound signals $LS_1$ 304, $LS_2$ 306, and $LS_3$ 308 via the second transfer function ($TF_2$) 312. Also in certain embodiments, the symbol "N" represents the respective loudspeaker sound signal 304, 306, 308 for the respective loudspeaker 110 (i.e., at the loudspeaker itself), and the loudspeaker cancellation noise value ($N_r$) at the particular microphone location is calculated using the following equation:

$$Nr=N*TF2 \quad \text{(Equation 2),}$$

in which * represents the convolution function.

Also in various embodiments, for each particular microphone 106 location, the corresponding loudspeaker cancellation noise value 324 for the particular microphone 106 location (i.e., $N_r$) is subtracted from the corresponding measured aggregate sound 322 for the particular microphone 106 location at point 320 of FIG. 3. The subtraction at point 320 thereby estimates the engine noise at the particular microphone 106 location, denoted as "$E_r$" 326 in FIG. 3, in accordance with the following equation:

$$Er=R-Nr=R-N*TF2 \quad \text{(Equation 3),}$$

in which * denotes the convolution function.

Also in various embodiments, for each virtual location 116 of FIG. 1, the loudspeaker sound signals (e.g., $LS_1$ 304, $LS_2$ 306, and $LS_3$ 308) are also each processed through a respective first transfer function ($TF_1$) 310 for each virtual location 116. Accordingly, for each virtual location 116, the first transfer function ($TF_1$) 310 generates a loudspeaker cancellation noise value ($N_v$) 330 for the particular virtual location 116 based on the processing of the loudspeaker sound signals $LS_1$ 304, $LS_2$ 306, and $LS_3$ 308 via the first transfer function ($TF_1$) 310. As noted above, in various embodiments, a plurality of virtual locations 116 may be utilized, for example for different occupants 112 of the vehicle 104 cabin 102, and/or for different ears of the occupant 112, and the like. In various embodiments, for each particular virtual location 116, the loudspeaker cancellation noise value ($N_v$) is calculated in accordance with the following equation:

$$N_v=N*TF_1 \quad \text{(Equation 4),}$$

in which * denotes the convolution function.

In various embodiments, for each particular microphone 106 location and virtual location 116 combination (i.e., for each microphone 106 location for each virtual location 116), the estimated engine noise at the particular microphone 106 location ($E_r$ 326) is processed through a respective third transfer function ($TF_3$) for each respective virtual location 116, to thereby generate a resulting estimated engine noise at the particular virtual location 116 ($E_v$ 328) for each particular microphone 106 location/virtual location 116 combination. In various embodiments, for each particular virtual location, the estimated engine noise at the particular virtual location, namely "$E_v$", is calculated using the following equation:

$$Ev=Er*TF3 \quad \text{(Equation 5),}$$

in which * denotes the convolution function.

In various embodiments, one or more engine parameters (such as engine torque and/or a measure of engine revolutions per amount of time, such as revolutions per minute (rpm)) are utilized in combination with the third transfer function ($TF_3$) and/or as part of the third transfer function ($TF_3$) in calculating the estimated engine noise at the particular virtual location ("$E_v$"). For example, in certain embodiments, the third transfer function ($TF_3$) is calibrated using different values of engine torque and engine rpm during the generation of the transfer functions during step 202 of FIG. 2 (described in greater detail further below), and are then combined as additional input values for the third transfer functions based on current measurements of the engine parameters of step 204 of FIG. 2.

In addition, in various embodiments, for each particular virtual location 116, the estimated engine noise at the particular virtual location 116 ($E_v$ 328) is added to the loudspeaker cancellation noise value ($N_v$) 330 for the particular virtual location 116 at point 332. As a result of the summation at point 332, a resulting aggregate sound (V) 334 is generated for the particular virtual location 116. In various embodiments, for each virtual location, the resulting aggregate sound, namely "V", is calculated using the following equation:

$$V=E_v+N_v=(R-N*TF_2)*TF_3+N*TF_1 \quad \text{(Equation 6)},$$

in which * denotes the convolution function.

In various embodiments, the aggregate sounds 334 (V) for the virtual locations 116 are used by the ANC output generator 302 to provide and/or adjust the loudspeaker signals (e.g., LS1 304, LS2 306, and LS3 308) to compensate for the aggregate sounds (V) 334 at the virtual locations 116. For example, in certain embodiments, the existing loudspeaker signals (e.g., $LS_1$ 304, $LS_2$ 306, and $LS_3$ 308) are adjusted, as much as possible, to provide anti-noise (i.e., noise cancellation) that would cancel out, and thereby reduce or eliminate, the aggregate sounds (V) 334 at the virtual locations 116. In certain embodiments with multiple virtual locations 116 (e.g., for different ears of an occupant), the aggregate sounds (V) 334 may be averaged and/or aggregated so as to maximize the combined effectiveness of the anti-noise for the virtual locations 116 (e.g., an optimization function may be utilized in certain embodiments that results in a lower perceived tone to help avoid asymmetric cancellation at the two ears of the same occupant). In certain embodiments, the current ANC system is capable of taking in multiple error microphones at occupant locations. Accordingly, in certain embodiments, multiple virtual microphone signals are estimated using the various transfer functions $T_1$, $T_2$, and $T_3$ and are then fed to the ANC system for noise cancellation.

In various embodiments, the processor 108 of FIG. 1 comprises and/or is part of the ANC output generator 302 of FIG. 3. Also in various embodiments, the processor 108 provides instructions for the loudspeaker signals (e.g., LS1 304, $LS_2$ 306, and $LS_3$ 308); applies the transfer functions $TF_1$ 310, $TF_2$ 312, and $TF_3$ 314; provides the calculations at points 320 and 332; and otherwise provides the steps of step 212 of FIG. 3 and the process 200 in general, except as otherwise noted or implied herein (e.g., the microphones 106 measuring and recording sound values, the loudspeakers 110 producing the anti-noise, the sensors 105 (not depicted in FIG. 3) measuring engine 103 values, and so on).

Figure 4:
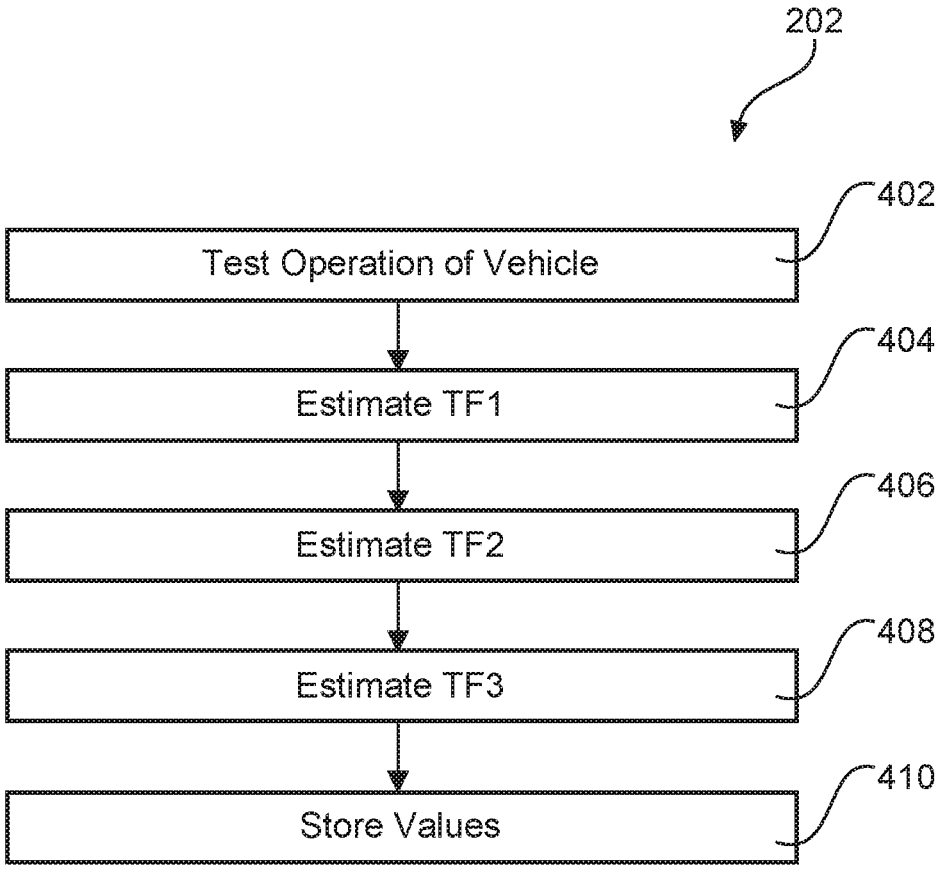
FIG. 4 is a flowchart illustrating an exemplary embodiment of a step of the method of FIG. 2, namely, generating transfer functions, in accordance with various embodiments.

With reference to FIG. 4, a flowchart is provided for step 202 of the process 200 of FIG. 2, namely, generating transfer functions, in accordance with various embodiments. In various embodiments, test vehicles (e.g., of the same type, such as the same vehicle make and model as the vehicle 104 of FIG. 1) are operated during step 402 at different time periods prior to the operation of the vehicle 104 of FIG. 1 during steps 204-214. For example, in various embodiments, the test vehicles are operated during product development and testing for the particular type of vehicle, for example before the particular vehicle 104 of FIG. 1 is sold in the marketplace. Also in various embodiments, the test vehicles are otherwise similar to the vehicle 104 of FIG. 1.

In addition, in various embodiments, during step 402, the test vehicles are operated during multiple testing periods, including (i) one or more first time periods in which a loud speaker of the test vehicle is producing noise cancellation sound of the test vehicle; and (ii) one or more second time periods in which the engine of the test vehicle is running but the loud speaker of the test vehicle is not producing the noise cancellation sound of the test vehicle.

The first transfer function ($TF_1$) is estimated at step 404. In various embodiments, a first plurality of testing sounds are recorded at a first location corresponding to a location of the microphone of the vehicle during the first time period, and the first transfer function $TF_1$ is estimated using the first testing sounds, for example using techniques known in the art. Also in various embodiments, the first transfer function $TF_1$ is estimated using a processor, such as the processor 108 of FIG. 1.

The second transfer function ($TF_2$) is estimated at step 406. In various embodiments, a second plurality of testing sounds are recorded at a second location corresponding to the virtual location of the vehicle during the first time period, and the second transfer function $TF_2$ is estimated using the second testing sounds. Also in various embodiments, the second transfer function $TF_2$ is estimated using a processor, such as the processor 108 of FIG. 1.

The third transfer function ($TF_3$) is estimated at step 408. In various embodiments, a third plurality of testing sounds are recorded at the first location during the second time period, fourth testing sounds are recorded at the second location during the second time period, and the third transfer function is estimated using the third testing sounds and the fourth testing sounds. As noted above, in various embodiments, one or more engine parameters (such as engine torque and/or a measure of engine revolutions per amount of time, such as revolutions per minute (rpm)) are utilized in combination with the third transfer function ($TF_3$) and/or as part of the third transfer function ($TF_3$). For example, in certain embodiments, the third transfer function ($TF_3$) is calibrated in step 408 at least in part using different values of engine torque and engine rpm during the operation of the test vehicles. In certain embodiments, the parameters of the third transfer function ($TF_3$) may vary with engine torque and engine rpm, among other possible variations. In certain embodiments, the revolutions per minute of the engine and an engine torque are measured during the second time period while recording the third testing sounds and the fourth testing sounds, and the third transfer function is estimated using the third testing sounds, the fourth testing sounds, the engine revolutions per minute, and the engine torque. Also in various embodiments, the third transfer function $TF_3$ is estimated using a processor, such as the processor 108 of FIG. 1.

In various embodiments, the first, second, and third transfer functions ($TF_1$, $TF_2$, and $TF_3$) are stored in memory at step 410. In various embodiments, for each vehicle, such as the vehicle 104 of FIG. 1, the first, second, and third transfer functions ($TF_1$, $TF_2$, and $TF_3$) are stored in a memory, such as the memory 109 of FIG. 1, before the vehicle 104 is purchased by a consumer and operated on the roads. The respective transfer functions will then be ready to be retrieved by the processor 108 during operation of the vehicle, for example in step 210 of FIG. 2, as described above.

Figure 5:
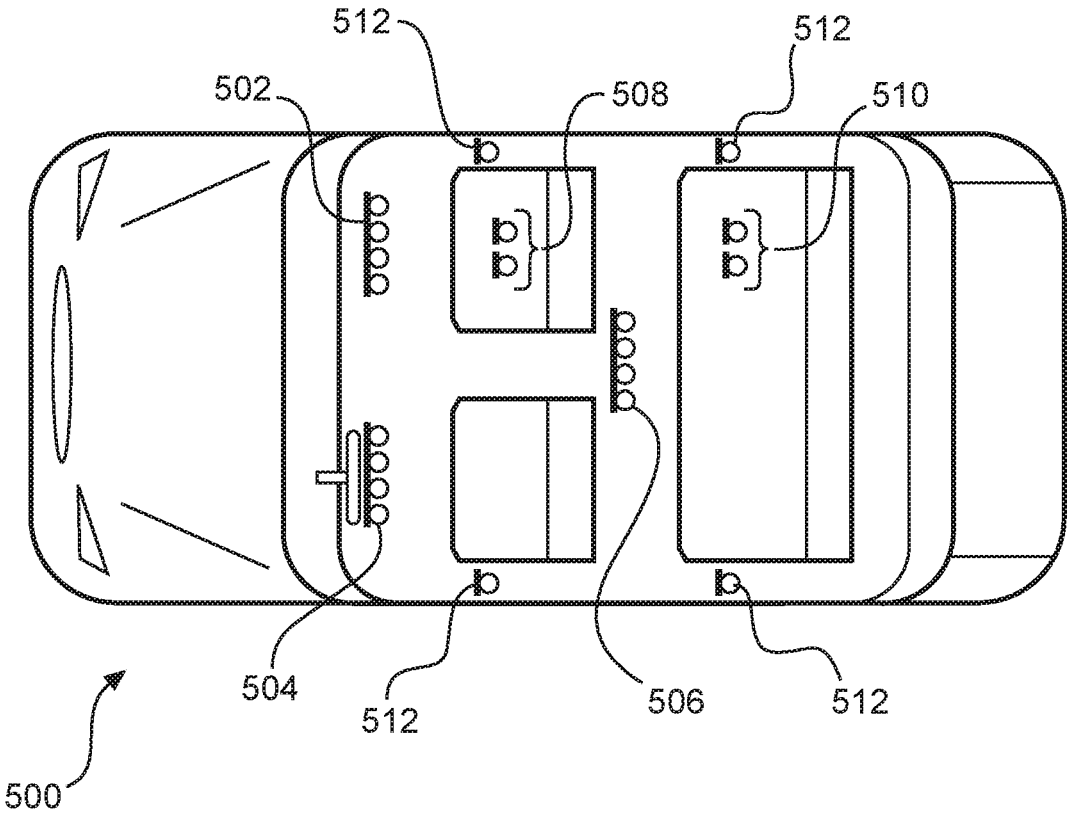
FIG. 5 is a block diagram of a test vehicle used in connection with the step of FIG. 4.

FIG. 5 is a block diagram of a test vehicle 500 used in connection with step(s) 202 of FIG. 4, in accordance with various embodiments. As depicted in the exemplary embodiment, in various embodiments microphones may be placed in any number of positions in the vehicle for testing purposes, including certain exemplary first positions 502, second positions 504, third positions 506, fourth positions 508, fifth positions 510, and sixth positions 512.

In various embodiments, the first, second, and third positions 502, 504, and 506 represent different positions for actual microphone locations in a vehicle. In various embodiments, the first, second, and third positions 502, 504, and 506 represent respective positions for arrays of voice recognition microphones that are also used for noise cancelling functionality (e.g., corresponding to the microphone 106 of FIG. 1). In the depicted embodiment, each of the actual microphone locations 502, 504, 506 include an array of four microphones for each location; however, the number of microphones per location may vary in other embodiments.

Also in various embodiments, the fourth, fifth, and sixth positions 508, 510, and 512 represent different positions for virtual locations for the vehicle (e.g., in proximity to ears of passengers of the vehicle). In various embodiments, the fourth, fifth, and sixth positions 508, 510, and 512 represent respective positions for the virtual location 116 of FIG. 1. Also in certain embodiments, the sixth locations 512 represent a position in which noise cancelling microphones may be present in certain existing vehicles, but for which noise cancelling microphones may no longer be required, but may be instead be effectively replaced with the "virtual location" with the techniques described in this Application. Also in certain embodiments, the virtual location may be improved further, with locations 510 and 512 that are even closer to the ears of the occupants of the vehicle cabin, in accordance with the techniques described in this Application.

Figure 6:
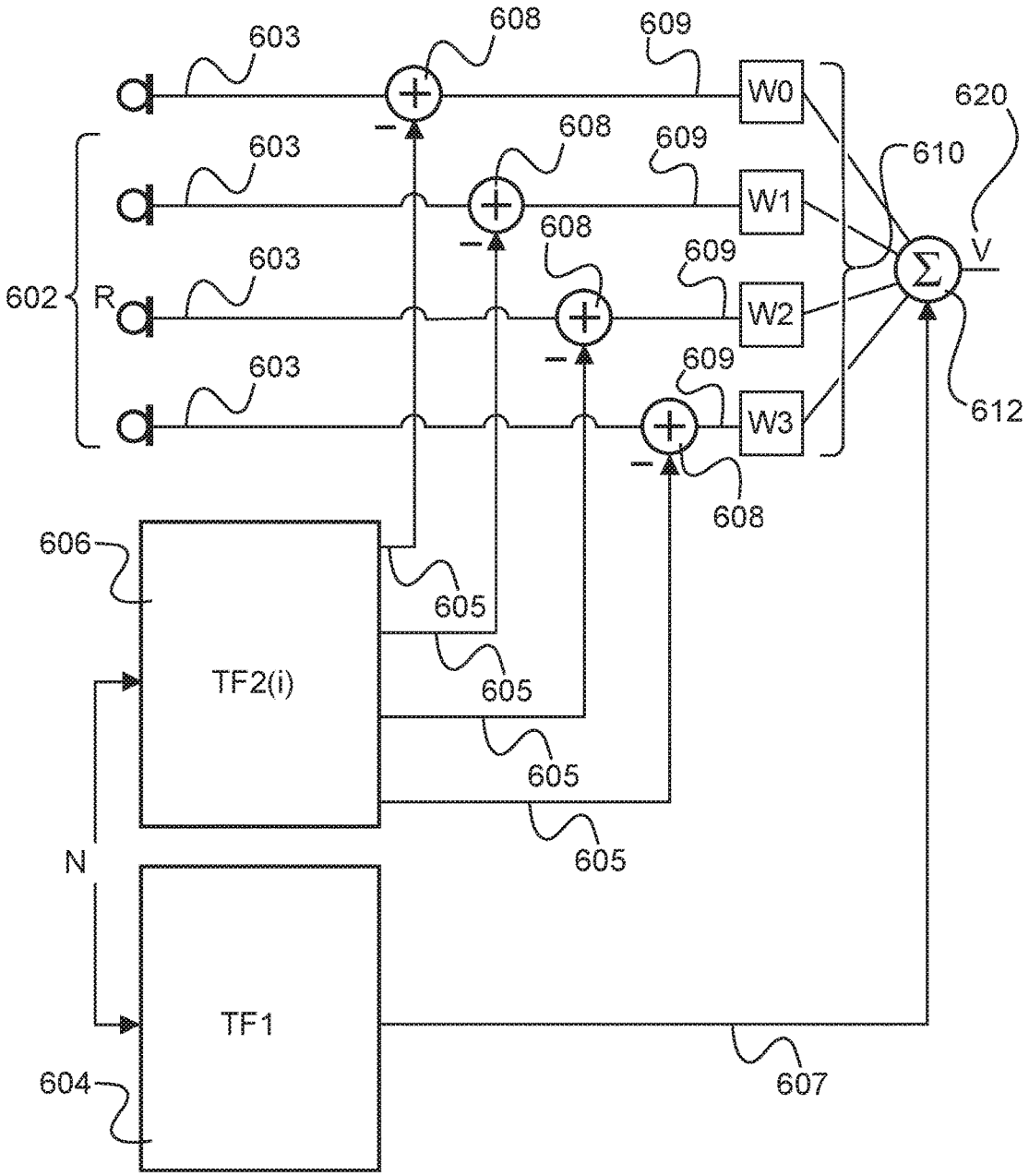
FIGS. 6 and 7 are flow diagrams illustrating exemplary embodiments of the step of FIG. 4, in accordance with various embodiments.
Figure 7:
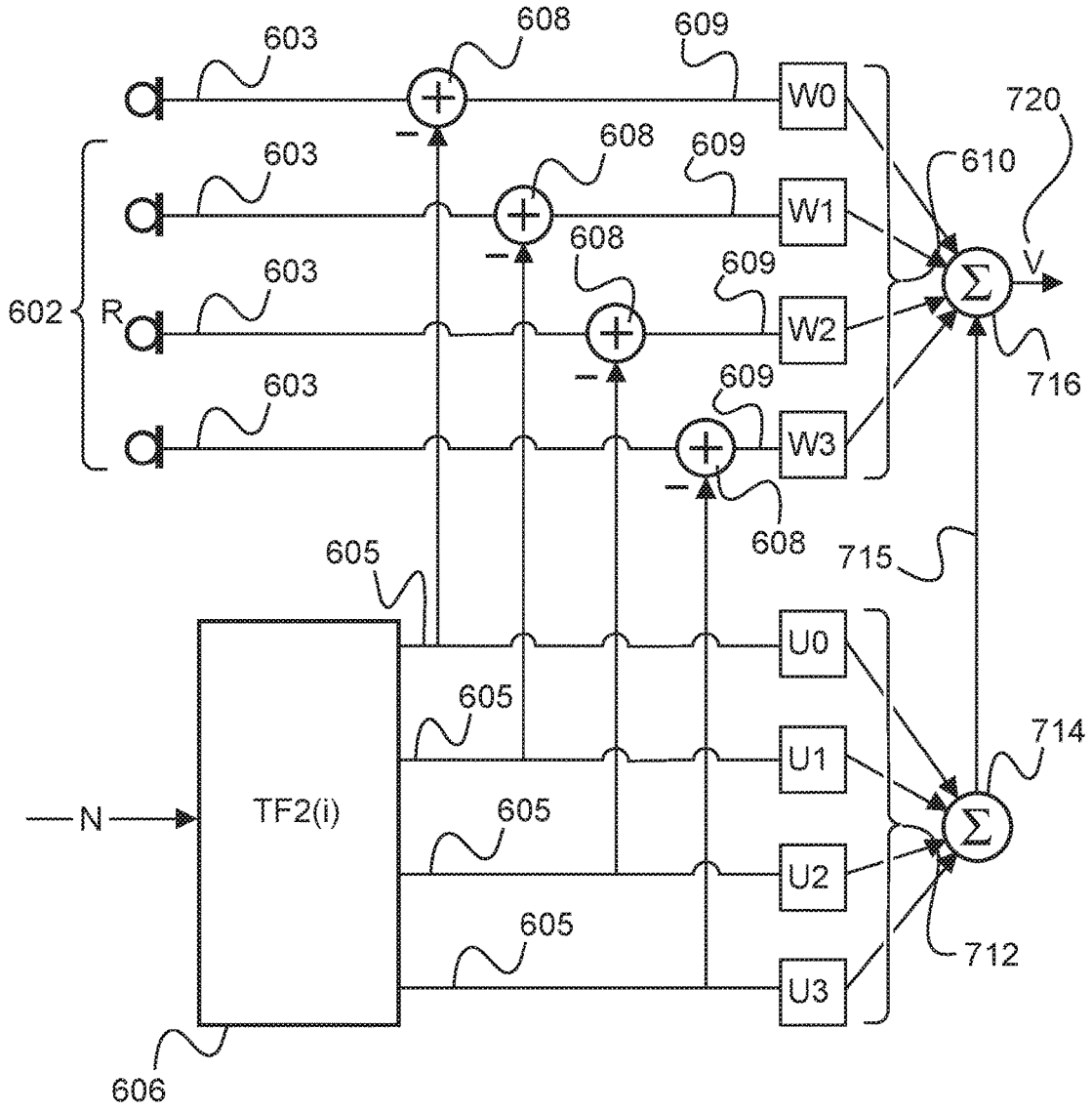

With reference now to FIGS. 6 and 7, the microphone arrays of locations 502, 504, and/or 506 may be utilized for producing aggregate results for the virtual locations in different manners as presented in FIGS. 6 and 7.

With reference to FIG. 6, in a first example, an array of microphones 602 corresponding to one of locations 502, 504, or 506 of FIG. 5 are utilized to measure recorded aggregate sounds 603 for the respective microphone location (i.e., aggregate sounds of engine noise combined with loudspeaker noise). As shown in FIG. 6, respective second transfer functions ($TF_{2(i)}$) for each location, along with the first transfer function ($TF_1$) (in the aggregate) utilize the loudspeaker sound from the loudspeakers "N" as inputs for producing respective values 605 for the second transfer functions ($TF_{2(i)}$), while the first transfer function ($TF_1$) utilizes the loudspeaker sound from the loudspeakers "N" as inputs for producing aggregate loudspeaker sound values 607.

As depicted in FIG. 6, in various embodiments, for each microphone location, a respective transfer function 606 ($TF_{2(i)}$) is utilized to generate a loudspeaker noise 605 for the particular location. The loudspeaker noise 605 for each particular location is subtracted from the aggregate sounds 603 for each location at respective summation points 608, resulting in estimated engine noise sounds 609 for each respective location. The estimated engine noise sounds 609 at the respective locations are then assigned respective weights 610, and are aggregated together at summation point 612 utilizing the third transfer function ($TF_3$) along with an aggregate loudspeaker sound 607 obtained via first transfer function $TF_1$ 604, thereby resulting in the total, aggregate sound "V" 620 for the microphone array. In certain embodiments, separate individual transfer functions may be utilized instead of the different weights, among other possible variations In various embodiments corresponding to FIG. 6, the calculations are performed in accordance with the following equations (in which * denotes the convolution function, as before):

$$R=E_r+N_r \quad \text{(Equation 7)},$$

in which "R" is the aggregate symbol that is captured by the remote microphone array;

$$V=E_v+N_v \quad \text{(Equation 8)},$$

In which "V" is the signal that the method is solving for, namely, the noise at the virtual location;

$$N_r=N*TF_2 \quad \text{(Equation 9)},$$

in which N is known from operation of the ANC system and TF2 is generated during operation of the test vehicles;

$$E_r=R-N_r=R-N*TF_2 \quad \text{(Equation 10)};$$

$$E_v=\Sigma E_{ri}*W_i \quad \text{(Equation 11); and}$$

$$N_v=\Sigma N_{ri}*U_i \quad \text{(Equation 12)},$$

in which $W_i$ and $U_i$ are calculated during the testing/tuning process using a testing system (e.g., one or more learning management systems) adaptation in various embodiments, and in which $W_i$ and $U_i$ are frequently dependent in certain embodiments.

Next, with reference to FIG. 7, in a second example, the array of microphones 602 corresponding to one of locations 502, 504, or 506 of FIG. 5 are utilized in a different manner to measure recorded aggregate sounds 603 for the respective microphone location (i.e., aggregate sounds of engine noise combined with loudspeaker noise). As shown in FIG. 7, respective second transfer functions ($TF_{2(i)}$) for each location utilize the loudspeaker sound from the loudspeakers "N" as inputs for producing respective values 605 for the second transfer functions ($TF_{2(i)}$). Also as depicted in FIG. 7, for each microphone location, a respective transfer function 606 ($TF_{2(i)}$) is utilized to generate a loudspeaker noise 605 for the particular location. The loudspeaker noise 605 for each particular location is subtracted from the aggregate sound 603 for each location at respective summation points 608, resulting in estimated engine noise sounds 609 for each respective location. The estimated engine noise sounds 609 at the respective locations are then assigned respective weights 610. In addition, the loudspeaker noises 605 for the respective locations are assigned respective weights 712, which are then aggregated at first summation 714 using the first transfer function $TF_1$, resulting in a first summed value 715. The first summed value 715 is then aggregated with weights (or weighted values) 610 at second summation 716 utilizing third transfer function $TF_3$, thereby resulting in the total, aggregate sound "V" 720 for the microphone array. In certain embodiments, the weights may be dependent on the frequency. In various embodiments corresponding to FIG. 7, the calculations are performed in accordance with the same or similar equations as Equations 7-12 described above in connection with FIG. 6.

Figure 8:
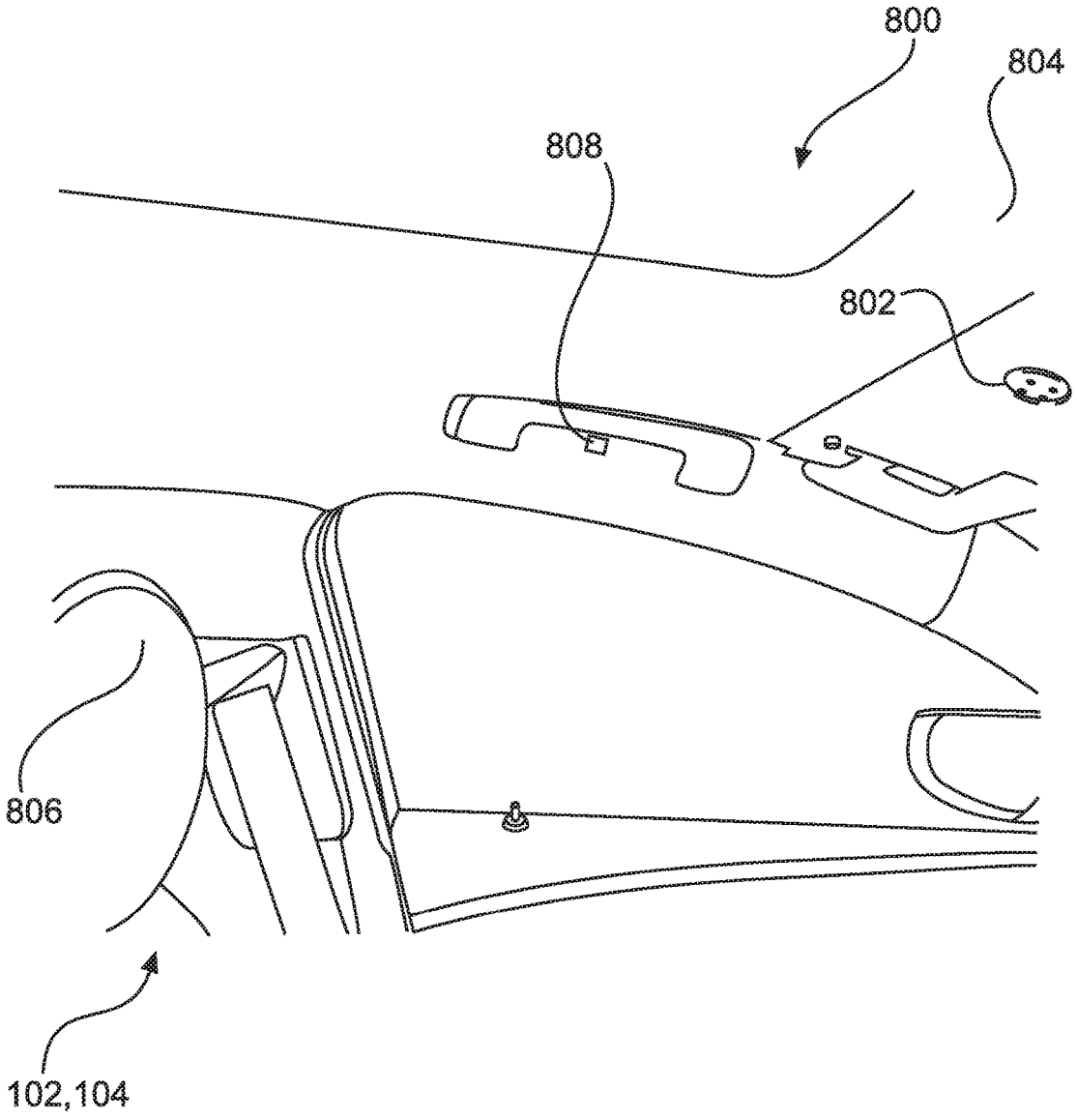
FIGS. 8 and 9 depict respective front and rear portions of a cabin of a vehicle, such as the vehicle of FIG. 1, illustrating exemplary microphone locations in accordance with the methods represented in FIGS. 2-7, in accordance with various embodiments.
Figure 9:
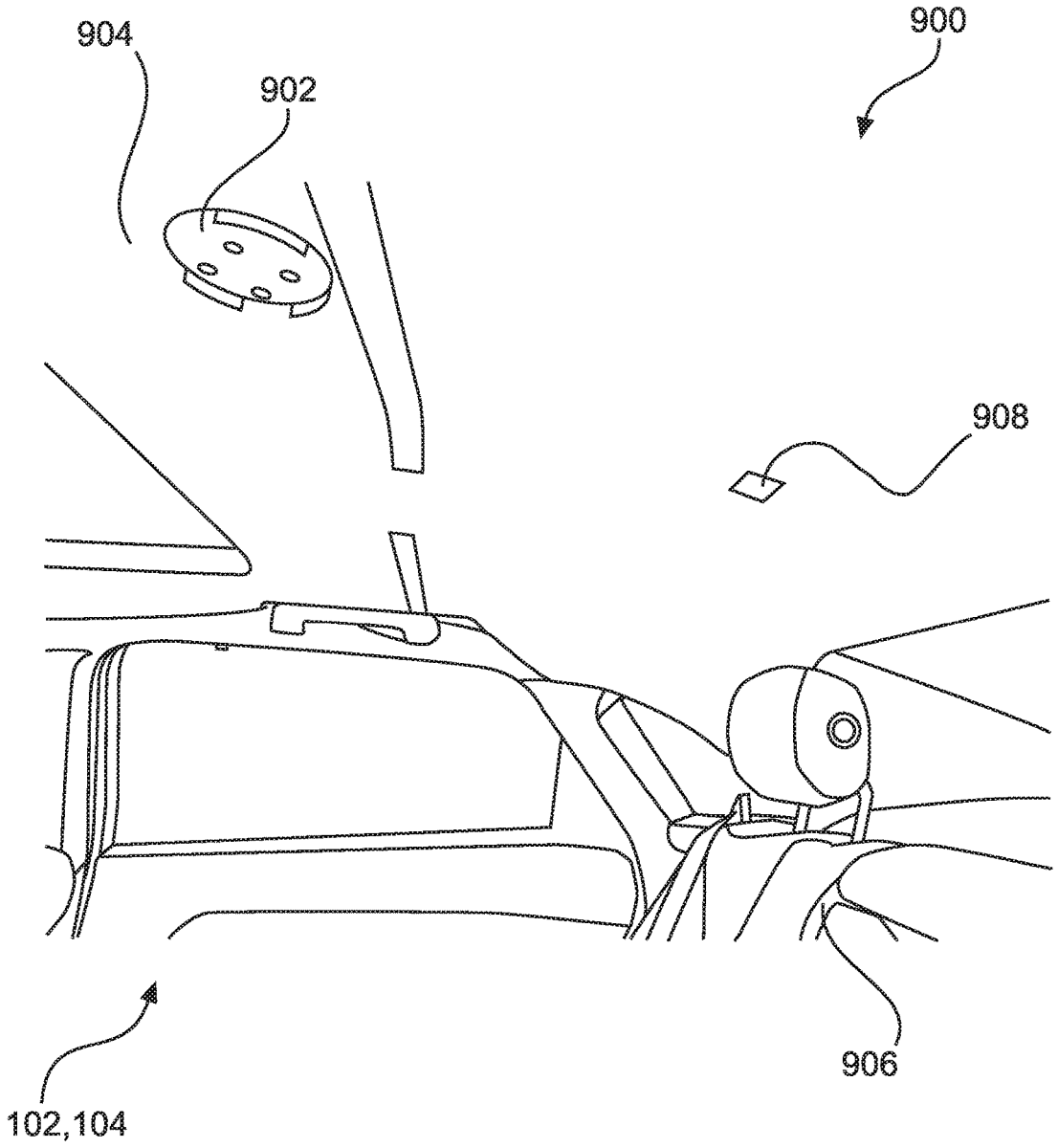

FIGS. 8 and 9 depict respective front and rear portions 800, 900, respectively, of a cabin of a vehicle, such as the cabin 102 of vehicle 104 of FIG. 1, illustrating exemplary microphone locations in accordance with the methods represented in FIGS. 2-7, in accordance with various embodiments.

First, with reference to FIG. 8, a front portion 800 of the cabin 102 of the vehicle 104 is illustrated, in accordance with exemplary embodiments. In certain embodiments, the front portion 800 corresponds to a front row of seating, for example including a driver and another front row passenger for the vehicle 104. As shown in FIG. 8, in various embodiments, in accordance with the techniques described herein, a microphone array 802 is positioned proximate a headliner 804 of the front portion 800 of the vehicle cabin, away from the front seat 806 depicted in FIG. 8. In various embodiments, the microphone array 802 is used both for passenger voice recognition and noise cancelling. Also in various embodiments, a second noise cancelling microphone at location 808 is no longer required (as it would be for other vehicles), due to the techniques utilized in this Application. Instead, the microphone array 802 is used to generate noise cancellation with respect to one or more virtual locations (e.g., proximate the ears of the passenger when seating in front seat 806), in various embodiments.

Second, with reference to FIG. 9, a rear portion 900 of the cabin 102 of the vehicle 104 is illustrated, in accordance with exemplary embodiments. In certain embodiments, the rear portion 900 corresponds to one or more rear rows of seating, for example including passengers in one or more rear rows behind the driver for the vehicle 104. As shown in FIG. 9, in various embodiments, in accordance with the techniques described herein, a microphone array 902 is positioned proximate a headliner 904 of the rear portion 900 of the vehicle cabin, away from the rear seat 906 depicted in FIG. 9. In various embodiments, the microphone array 902 is used both for passenger voice recognition and noise cancelling. Also in various embodiments, a second noise cancelling microphone at location 908 is no longer required (as it would be for other vehicles), due to the techniques utilized in this Application. Instead, the microphone array 902 is used to generate noise cancellation with respect to one or more virtual locations (e.g., proximate the ears of the passenger when seating in rear seat 906), in various embodiments.

As illustrated in FIGS. 8 and 9, in various embodiments, the microphones no longer need to be in close proximity to the ears of occupants of the vehicle cabin, as would need to be the case in existing noise cancelling systems. In certain embodiments of the present Application, the microphones 106 are placed at a distance that is greater than 1/10 of a wavelength from each of the occupants' ears. For example, in certain embodiments of the present Application in which noise cancelling is performed up to 200 Hz, the microphones 106 are greater than seventeen centimeters from the closest ear of the closest occupant of the vehicle. This is made possible by the combined use of the microphones 106 as both voice recognition microphones and noise cancelling microphones, using the virtual location(s) made possible by the transfer functions $TF_1$, $TF_2$, and $TF_3$ discussed above. This can potentially provide a more pleasing appearance and experience for occupants of the vehicle (e.g., with a less cluttered microphone display, and a more accurate estimate of the noise using the virtual location(s)), and can also result in a cost reduction by not requiring additional ANC microphones. In contrast, existing vehicles that use separate ANC microphones (without the techniques, including the virtual location, of this Application) would need to have the separate ANC microphones, and these separate ANC microphones would need to be at a distance that is less than 34/F from an ear of a closest occupant to the microphone (accordingly, for a vehicle with a maximum frequency for noise cancellation is equal to 200 Hz, such vehicles would need to have a separate ANC microphone that is within seventeen centimeters from an occupant's ear).

Accordingly, methods, systems, and vehicles are disclosed that provide for active noise cancelling in vehicles. In various embodiments, sound values are estimated at a virtual location that is remote from a microphone location. Also in various embodiments, the estimated sound values are utilized by the processor in controlling noise cancellation for the vehicle. In addition, in various embodiments, the methods, systems, and vehicles utilize virtual locations that are proximate ears of occupants of the vehicle, using antennas that are remote from the virtual location, and thus that are remote from the occupant's ears. This potentially provides for integration of the noise cancelling microphones with existing voice microphones of the vehicle, and/or for improved noise cancelling performance (e.g., by having the virtual location be even closer to the occupants' ears as compared with existing techniques and systems).

It will be appreciated that the disclosed methods, systems, and vehicles may vary from those depicted in the Figures and described herein. For example, the audio system 100, the vehicle 104, and/or various components thereof may vary from that depicted in FIG. 1 and described in connection therewith. It will similarly be appreciated that the steps of the process 200 may differ from and/or be performed in a different order than, and/or may otherwise differ from, and/or be implemented differently than, the illustrations in FIGS. 2-9 and/or the discussions above in connection therewith.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method of controlling noise in a cabin of a vehicle, the method comprising:

measuring a first sound via a microphone in the cabin;

obtaining a second sound from a loudspeaker of the cabin;

estimating, via a processor, a third sound at a virtual location that is remote from both the microphone and the loudspeaker, using the first sound, the second sound, and one or more transfer functions; and applying active noise cancellation for the cabin based on the third sound at the virtual location; wherein:

the step of measuring the first sound comprises measuring an aggregate sound at the microphone that includes a sound of an engine of the vehicle;

the step of obtaining the second sound comprises obtaining a noise cancellation sound generated via the loudspeaker;

the method further comprises:

estimating an engine sound at the microphone using the aggregate sound at the microphone, the noise cancellation sound generated via the loudspeaker, and a first transfer function; and estimating an engine sound at the virtual location using the estimated engine sound at the microphone and a second transfer function; and the step of estimating the third sound comprises estimating the third sound, which includes an aggregate sound at the virtual location, using the estimated engine sound at the virtual location, the noise cancellation sound, and a third transfer function.

2. The method of claim 1, further comprising:

measuring a torque, a number of revolutions per amount of time, or both, of the engine; and the step of estimating the third sound comprises estimating an aggregate sound at the virtual location, using the estimated engine sound at the virtual location, the noise cancellation sound, the third transfer function, and one or both of the torque and revolutions of the engine.

3. The method of claim 1, wherein the third sound is estimated using the following equation:

$$V=E_v+N_v=(R-N*TF_2)*TF_3+N*TF_1,$$

in which V represents the aggregate sound at the virtual location, $E_v$ represents the engine sound at the virtual location, $N_v$ represents the noise cancellation sound at the virtual location, R represents the aggregate sound at the microphone, N represents the noise cancellation sound generated at the loudspeaker, $TF_1$ represents the first transfer function, $TF_2$ represents the second transfer function, and $TF_3$ represents the third transfer function, and the operator * denotes a convolution operation.

4. The method of claim 1, further comprising:

operating a test vehicle during a first time period in which a loud speaker of the test vehicle is producing noise cancellation sound of the test vehicle;

recording a first plurality of testing sounds at a first location corresponding to a location of the microphone of the vehicle during the first time period;

recording a second plurality of testing sounds at a second location corresponding to the virtual location of the vehicle during the first time period;

operating the test vehicle during a second time period in which an engine of the test vehicle is running but the loud speaker of the test vehicle is not producing the noise cancellation sound of the test vehicle;

recording a third plurality of testing sounds at the first location during the second time period;

recording a fourth plurality of testing sounds at the second location during the second time period;

estimating the first transfer function using the first testing sounds;

estimating the second transfer function using the second testing sounds; and estimating the third transfer function using the third testing sounds and the fourth testing sounds.

5. The method of claim 4, further comprising:

measuring revolutions per minute of the engine and an engine torque during the second time period while recording the third testing sounds and the fourth testing sounds;

wherein the step of estimating the third transfer function comprises estimating the third transfer function using the third testing sounds, the fourth testing sounds, the engine revolutions per minute, and the engine torque.

6. The method of claim 1, wherein:

the step of measuring the first sound comprises measuring a plurality of first sounds via a microphone array comprising a plurality of microphones in the cabin; and the step of estimating the third sound comprises estimating, via the processor, the third sound at the virtual location that is remote from each of the plurality of microphones of the microphone array and also remote from the loudspeaker, using the plurality of first sounds, the second sound, and one or more transfer functions for each of the plurality of microphones in the array.

7. A system for controlling noise in a cabin of a vehicle, the system comprising:

a microphone configured to measure a first sound in the cabin; and a processor in communication with the microphone and configured to at least facilitate:

obtaining a second sound from a loudspeaker of the cabin;

estimating a third sound at a virtual location that is remote from both the microphone and the loudspeaker, using the first sound, the second sound, and one or more transfer functions; and applying active noise cancellation for the cabin based on the third sound at the virtual location; wherein:

the microphone is configured to measure an aggregate sound at the microphone that includes a sound of an engine of the vehicle; and the processor is configured to at least facilitate:

obtaining a noise cancellation sound generated via the loudspeaker;

estimating an engine sound at the microphone using the aggregate sound at the microphone, the noise cancellation sound generated via the loudspeaker, and a first transfer function;

estimating an engine sound at the virtual location using the estimated engine sound at the microphone and a second transfer function; and estimating the third sound, which includes an aggregate sound at the virtual location, using the estimated engine sound at the virtual location, the noise cancellation sound, and a third transfer function.

8. The system of claim 7, further comprising:

one or more engine sensors configured to measure a torque, a number of revolutions per amount of time, or both, of the engine;

wherein the processor is configured to at least facilitate estimating the aggregate sound at the virtual location, using the estimated engine sound at the virtual location, the noise cancellation sound, the third transfer function, and one or both of the torque and revolutions of the engine.

9. The system of claim 7, wherein the processor is configured to estimate the third sound using the following equation:

$$V=E_v+N_v=(R-N*TF_2)*TF_3+N*TF_1,$$

in which V represents the aggregate sound at the virtual location, $E_v$ represents the engine sound at the virtual location, $N_v$ represents the noise cancellation sound as measured at the virtual location, R represents the aggregate sound at the microphone, N represents the noise cancellation sound generated at the loudspeaker, $TF_1$ represents the first transfer function, $TF_2$ represents the second transfer function, and $TF_3$ represents the third transfer function, and the operator * denotes a convolution operation.

10. The system of claim 7, further comprising:

a memory configured to store the first transfer function, the second transfer function, and the third transfer function after the first, second, and third transfer functions are generated by:

operating a test vehicle during a first time period in which a loud speaker of the test vehicle is producing noise cancellation sound of the test vehicle;

recording a first plurality of testing sounds at a first location corresponding to a location of the microphone of the vehicle during the first time period;

recording a second plurality of testing sounds at a second location corresponding to the virtual location of the vehicle during the first time period;

operating the test vehicle during a second time period in which the engine of the test vehicle is running but the loud speaker of the test vehicle is not producing the noise cancellation sound of the test vehicle;

recording a third plurality of testing sounds at the first location during the second time period;

recording a fourth plurality of testing sounds at the second location during the second time period;

estimating the first transfer function using the first testing sounds;

estimating the second transfer function using the second testing sounds; and estimating the third transfer function using the third testing sounds and the fourth testing sounds.

11. The system of claim 10, wherein the third transfer function is further generated by:

measuring revolutions per minute of the engine and an engine torque during the second time period while recording the third testing sounds and the fourth testing sounds; and estimating the third transfer function using the third testing sounds, the fourth testing sounds, the engine revolutions per minute, and the engine torque.

12. The system of claim 7, wherein:

the system comprises a microphone array comprising a plurality of microphones that are configured to measure a plurality of first sounds in the cabin; and the processor is configured to at least facilitate estimating the third sound at the virtual location that is remote from each of the plurality of microphones of the microphone array and also remote from the loudspeaker, using the plurality of first sounds, the second sound, and one or more transfer functions for each of the plurality of microphones in the array.

* * * * *